US006568719B2

(12) United States Patent
Buscella

(10) Patent No.: US 6,568,719 B2
(45) Date of Patent: May 27, 2003

(54) DOOR OPENING DEVICE, IN PARTICULAR FOR AN ELECTRIC HOUSEHOLD APPLIANCE DOOR

(75) Inventor: Claudio Buscella, Gassino Torinese (IT)

(73) Assignee: ITW Industrial Components, S.r.l., Milan (IT)

( * ) Notice: Subject to any disclaimer, the term of this patent is extended or adjusted under 35 U.S.C. 154(b) by 0 days.

(21) Appl. No.: 09/827,363

(22) Filed: Apr. 6, 2001

(65) Prior Publication Data

US 2001/0044988 A1 Nov. 29, 2001

(30) Foreign Application Priority Data

Apr. 7, 2000 (IT) ..... MI2000A0759

(51) Int. Cl.[7] ..... E05C 19/06
(52) U.S. Cl. ..... 292/85; 292/128
(58) Field of Search ..... 292/85, 87, 114, 292/120, 128, 136, 101, 102, 228, DIG. 30, DIG. 69, DIG. 71

(56) References Cited

U.S. PATENT DOCUMENTS

| | | | | | |
|---|---|---|---|---|---|
| 3,313,564 | A | * | 4/1967 | Pultz | 292/87 |
| 3,455,590 | A | * | 7/1969 | Zerfoss | 292/128 |
| 3,593,953 | A | * | 7/1971 | Gastaldi | 292/87 |
| 3,822,905 | A | * | 7/1974 | Bell | 292/87 |
| 4,478,005 | A | * | 10/1984 | Mundschenk | 49/388 |
| 5,934,115 | A | * | 8/1999 | Bernier | 70/208 |
| 6,076,869 | A | * | 6/2000 | Chen | 292/202 |
| 6,172,869 | B1 | * | 1/2001 | Hood | 361/681 |

* cited by examiner

*Primary Examiner*—Gary Estremsky
(74) *Attorney, Agent, or Firm*—Lowe Hauptman Gilman & Berner, LLP

(57) ABSTRACT

A device for opening a door, in particular an electric household appliance door, wherein a handle and a catch for engaging a respective seat are formed in a one-piece body from polymer material; and an elastic contrasting member, acting on the catch and defined, for example, by a metal plate, is also co-molded in a one-piece body with the handle and the catch, so that the device according to the invention has fewer component parts to assemble as compared with known devices.

20 Claims, 2 Drawing Sheets

Fig. 1
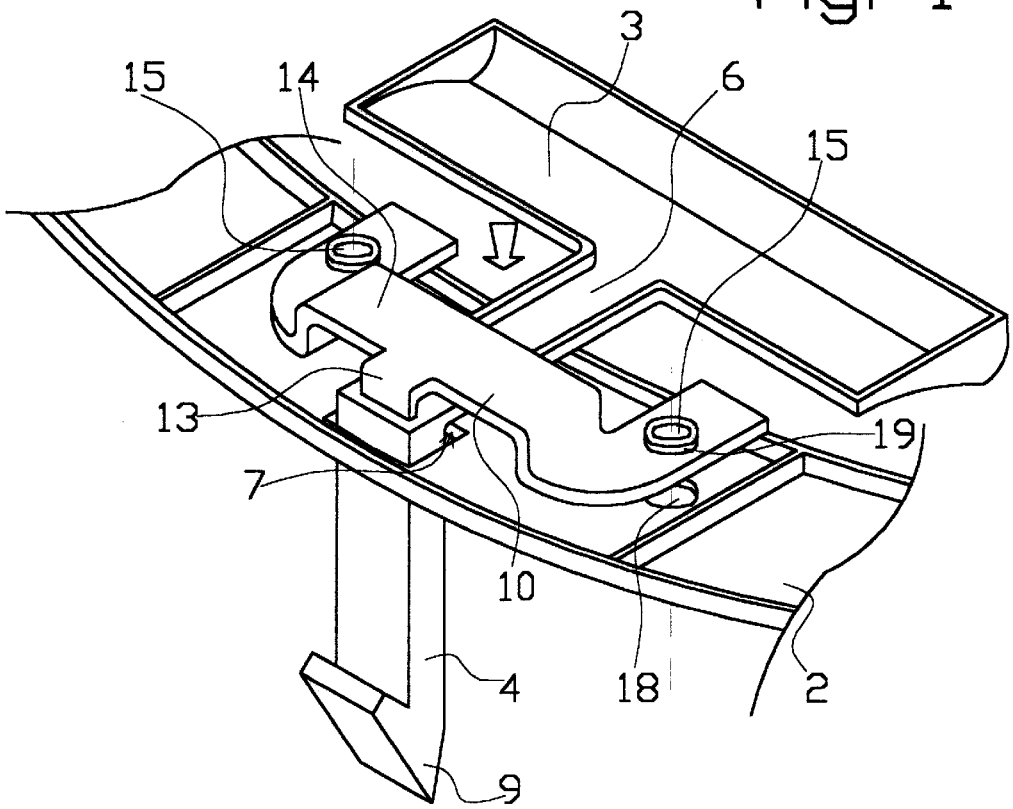
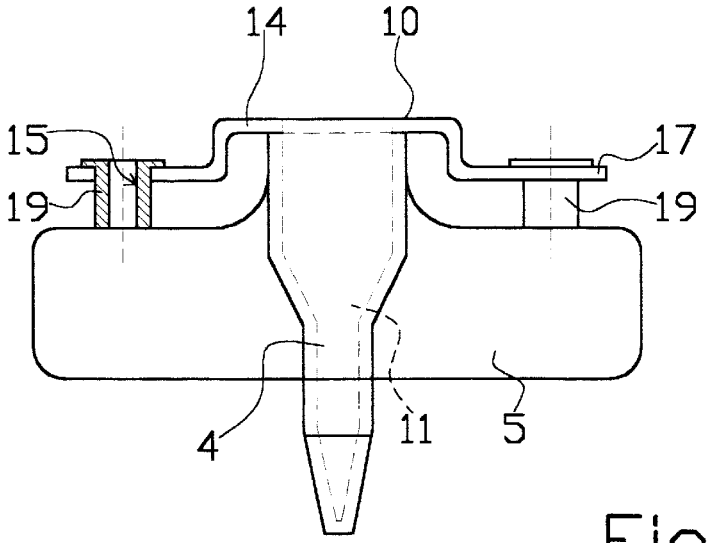
Fig. 4

DOOR OPENING DEVICE, IN PARTICULAR FOR AN ELECTRIC HOUSEHOLD APPLIANCE DOOR

The present invention relates to a door opening device, in particular for an electric household appliance door.

BACKGROUND OF THE INVENTION

Devices for opening electric household appliance, in particular washing-machine, doors are known to comprise a number of assembled components, typically: a handle gripped by the user and hinged by pins to the door; a catch fixed to and movable with the handle to engage a seat formed on the appliance; and a contrasting spring acting on the catch to keep it in the closed position while at the same time permitting release of the catch from the seat.

The major drawback of devices of this sort is the number of separate components for assembly, which obviously affects overall cost.

SUMMARY OF THE INVENTION

It is an object of the present invention to provide an opening device designed to eliminate the aforementioned drawbacks of known devices, and which, in particular, has a small number of components for assembly, is therefore cheap and easy to produce, and at the same time is both efficient and reliable.

According to the present invention, there is provided a device for opening a door, in particular an electric household appliance door, the device comprising a handle; a catch for engaging a respective seat; elastic contrasting means acting on said catch; and hinge means permitting rotation of said handle with respect to the door and, consequently, release of said catch from the respective seat; and being characterized in that said handle is formed in a one-piece body with said catch from polymer material; and in that said elastic means are defined by an elastic member projecting integrally from said handle and said catch.

The opening device according to the invention therefore has fewer components to assemble than known devices, is therefore cheaper and easier to produce and install, and is nevertheless highly efficient and reliable.

BRIEF DESCRIPTION OF THE DRAWINGS

A non-limiting embodiment of the present invention will be described by way of example with reference to the accompanying drawings, in which:

FIG. 1 shows a schematic view in perspective of an opening device in accordance with the invention being assembled to the respective door;

FIGS. 3 and 4 show plan and front views respectively of the FIG. 1 device (off the door).

DETAILED DESCRIPTION OF THE INVENTION

Figure 2:
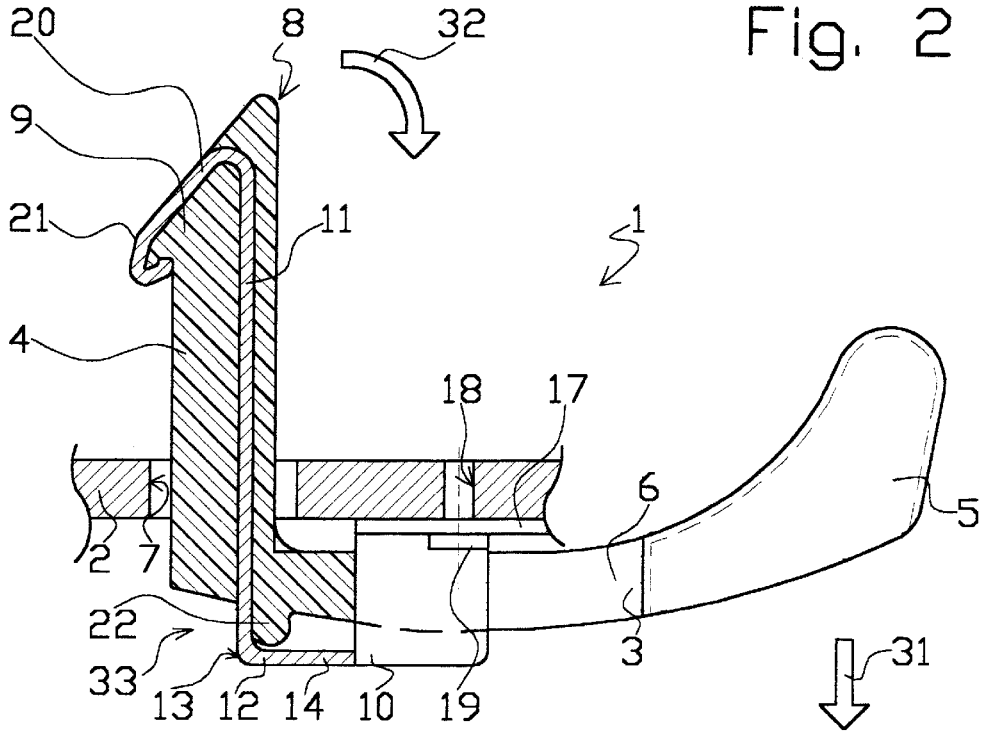
FIG. 2 shows a partly sectioned longitudinal view of the FIG. 1 device.
Figure 3:
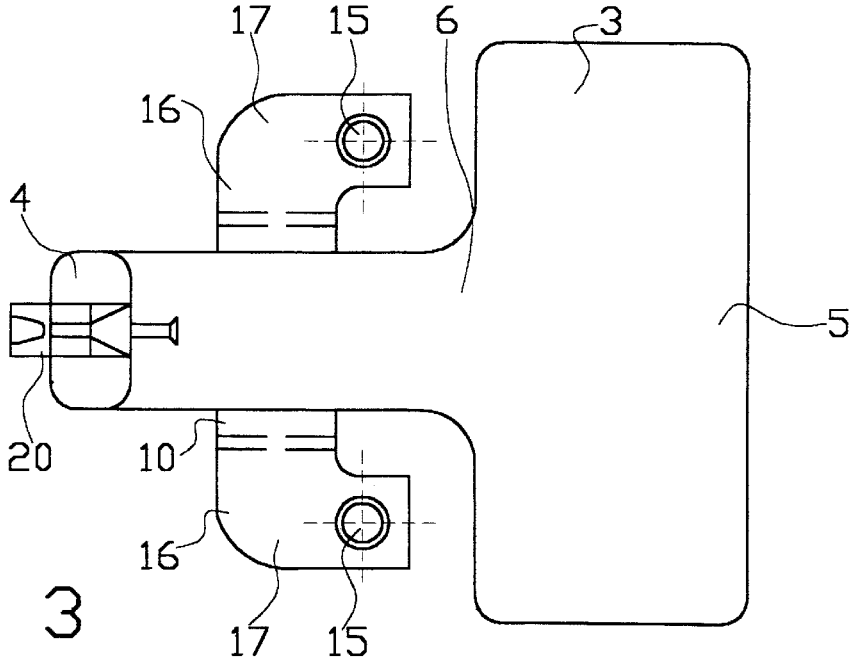

Number 1 in the accompanying drawings indicates as a whole a device for opening a door 2, e.g. a known door (not shown in detail for the sake of simplicity) of a known washing-machine. Device 1 comprises a handle 3; and a catch 4 for engaging in known manner a seat formed on the known washing-machine (not shown). In the example shown, handle 3 is substantially T-shaped, and comprises a grip portion 5 and a substantially perpendicular connecting portion 6 for connecting the grip portion to catch 4. Catch 4 is defined by a bar projecting perpendicularly from the end of connecting portion 6 opposite grip portion 5, is inserted loosely through an opening 7 in door 2, and has a retaining tooth 9 on the free end 8.

According to the invention, handle 3 is formed in a one-piece body with catch 4 from polymer material, and device 1 also comprises an elastic contrasting member 10 acting on catch 4 and projecting integrally from the one-piece body defined by handle 3 and catch 4. In a preferred embodiment, elastic member 10 is co-molded in a one-piece body with handle 3 and catch 4, and is defined by a contoured metal plate comprising a first portion 11 inserted inside catch 4 and embedded in the polymer material of catch 4 to form a reinforcing core of the catch, and a second portion 12 joined integrally to portion 11 and projecting outwards of catch 4. Portion 12 of elastic member 10 projects from the end of catch 4 opposite free end 8 supporting retaining tooth 9, and has an L-shaped bend 13 bent 90° towards grip portion 5; and, on the opposite side to portion 11, elastic member 10 has a substantially T-shaped end portion 14 with fastening means 15 (of any known type) for connection to door 2.

In one variation, elastic member 10 defined by the metal plate only comprises portions 12 and 13, and is connected to and projects from catch 4 in any known manner (e.g. is clicked inside a seat on catch 4) so that end portion 14 with fastening means 15 may be formed, e.g. co-molded, in one piece with the one-piece body defined by handle 3 and catch 4.

In the non-limiting example shown, T-shaped end portion 14 comprises two opposite aligned arms 16 terminating with respective plates 17 having through holes 15 aligned with respective threaded seats 18 formed in door 2 to receive respective screws and defining respective fastening points by which to fasten device 1 to door 2. Each plate 17 is bent 90° to respective arm 16 and is connected to it by a double S-shaped bend; and holes 15, as opposed to being aligned with bend 13, are offset laterally (FIG. 2) and formed in respective collars 19, which may be applied to or formed, e.g. molded, in one piece with elastic member 10.

At the opposite end to T-shaped end portion 14, elastic member 10 also comprises a head 20, which comes out of free end 8 of catch 4 and has a surface 21 sloping with respect to the longitudinal axis of catch 4 and resting on a corresponding outer front surface of catch 4 facing away from handle 3. Surface 21 of head 20 also extends to cover substantially the whole front surface of retaining tooth 9. Handle 3 comprises a projection 22, preferably with a rounded head and projecting from connecting portion 6 towards portion 12 of elastic member 10 at bend 13, so as to define a flexing point of elastic member 10.

In actual use (FIG. 2 in particular), device 1 is fitted firmly to door 2 by fastening means 15, with catch 4 inserted through opening 7. When the door is closed, catch 4 is secured (in known manner) to the washing-machine by known closing members, and in particular engages the corresponding seat on the washing-machine and is held in position by elastic member 10.

To open door 2, the user acts on grip portion 5 of handle 3 in the direction of arrow 31 in FIG. 2. Being secured to door 2 at the fastening points defined by holes 15, handle 3 flexes so that projection 22 flexes elastic member 10 at bend 13 to rotate catch 4, with respect to the bend point defined by bend 13, in the direction of arrow 32 in FIG. 2 and so release catch 4 from the respective seat to open door 2. Bend 13 of elastic member 10 and projection 22 of handle 3 thus define hinge means 33 permitting rotation of handle 3 with respect to the door and, consequently, release of catch 4 from the respective seat on the door.

To close door 2, the user pushes door 2 towards the washing-machine: on coming into contact with the washing-machine, surface 21 of catch 4 slides on a corresponding contacting member forming part of the closing members of the washing-machine, and at the same time flexes catch 4 in the direction of arrow 32 in FIG. 2 and in opposition to the elastic force exerted by elastic member 10; catch 4 and elastic member 10 therefore both flex together into a deformed position enabling catch 4 to engage its seat; and, once the seat is engaged, catch 4 is restored to and locked in the undeformed position by elastic member 10.

Clearly, changes may be made to the opening device as described and illustrated herein without, however, departing from the scope of the present invention. For example, in one possible variation (not shown, but by now clear to anyone skilled in the art), handle 3, again formed in a one-piece body with catch 4 and elastic member 10, is hinged to door 2 by pins; and elastic member 10 again projects from catch 4 to counteract rotation of handle 3 (and therefore catch 4), but does not comprise end portion 14 with fastening means 15. In this case, too, device 1 provides for reducing the number of component parts with respect to the known state of the art.

What is claimed is:

1. A device (1) for opening a door (2), the device comprising:

a handle (3);

a catch (4) for engaging a respective seat;

an elastic member (10) acting on said catch (4); and a hinge (33) permitting rotation of said handle with respect to the door and, consequently, release of said catch from the respective seat;

wherein said handle (3) is formed in a substantially L-shaped, one-piece body with said catch (4) from polymer material; and said elastic member (10) projects integrally from said L-shaped body, and is made of a material different from the polymer material of said L-shaped body.

2. A device as claimed in claim 1, wherein said elastic member (10) is co-molded with said handle (3) and said catch (4).

3. A device as claimed in claim 2, wherein said elastic member (10) is defined by a contoured metal plate, and comprises a first portion (11) inserted inside said catch (4) and embedded in the polymer material of said catch to form a reinforcing core of said catch.

4. A device as claimed in claim 3, wherein said elastic member (10) also comprises a second portion (12) joined integrally to said first portion (11) and extending outside said catch (4) of the polymer material to define said hinge (33).

5. A device as claimed in claim 1, wherein, in said L-shaped body, said handle extends at an angle to said catch, said handle has a grip end portion on the opposite side to a connection to said catch which grip end portion is adapted to be griped by a user's hand.

6. A device claimed in claim 5, wherein said catch has a hook-shaped end portion on the opposite side to the connection to said handle, said hook-shaped end portion has an outer surface sloping in a direction towards the connection and away from the grip end portion of said handle.

7. A device as claimed in claim 6, wherein said elastic member is made of metal, is partially embedded in said catch, and projects from and rests on the sloping surface of the hook-shaped end portion.

8. A device as claimed in claim 5, wherein said elastic member is generally L-shaped and has a first and second sections and a bend connecting the first and second sections, said first section being partially embedded in said catch, said second section and said bend being positioned outside said body, said second section extending generally in the same direction as said handle.

9. A device as claimed in claim 5, wherein said elastic member is generally L-shaped and has a first and second sections and a bend connecting the first and second sections, said first section being connected to and projecting from said body in a region of the connection, said second section and said bend being positioned outside said body, said second section extending generally in the same direction as said handle.

10. A device for opening a door, the device comprising:

a handle;

a catch for engaging a respective seat;

an elastic member acting on said catch; and a hinge permitting rotation of said handle with respect to the door and, consequently, release of said catch from the respective seat; wherein said handle is formed in a one-piece body with said catch;

said elastic member projects from said body, and comprises a first portion embedded in said catch to form a reinforcing core of said catch, and a second portion joined integrally to said first portion and extending outside said catch to define said hinge; and said second portion of the elastic member has a bend outside said catch, said body having a projection adjacent to said bend and defining a bend point of said elastic member.

11. A device as claimed in claim 10, wherein said elastic member also comprises an end portion connected integrally to said second portion on the opposite side to said first portion, said end portion being substantially T-shaped and having fastening elements for connection to the door.

12. A device as claimed in claim 11, wherein said elastic member also comprises a head connected integrally to said first portion on the opposite side to said second portion, said head projecting from said catch.

13. A device as claimed in claim 12, wherein said head has a surface sloping with respect to a longitudinal axis of said catch and resting on a corresponding surface of said catch.

14. A device as claimed in claim 10, wherein said body is made of polymer and said elastic member is made of metal, said metallic elastic member being co-molded with said polymer body.

15. In combination, a door for closing a chamber; and a device for opening said door, said device comprising a handle, a catch for engaging a respective seat formed in a wall of the chamber, an elastic member acting on said catch, and a hinge about which said handle rotates with respect to said door to permit release of said catch from the respective seat; wherein said handle is formed in a substantially L-shaped, one-piece body with said catch from polymer material;

in said L-shaped body, said handle extends at an angle to said catch, said handle has a grip end portion on the opposite side to a connection to said catch which grip end portion is adapted to be griped by a user's hand;

said catch extends through a hole formed in said door; and said elastic member is made of metal and co-molded with said polymer body.

16. The combination as claimed in claim 15, wherein said catch has a hook-shaped end portion on the opposite side to the connection to said handle, said hook-shaped end portion has an outer surface sloping in direction towards the connection and away from the grip end portion of said handle, and said elastic member is partially embedded in said catch, and projects from and rests on the sloping surface of the hook-shaped end portion.

17. In combination, a door for closing a chamber; and a device for opening said door, said device comprising a handle, a catch for engaging a respective seat formed in a wall of the chamber, an elastic member acting on said catch, and a hinge about which said handle rotates with respect to said door to permit release of said catch from the respective seat; wherein said handle is formed in a substantially L-shaped, one-piece body with said catch from polymer material;

in said L-shaped body, said handle extends at an angle to said catch, said handle has a grip end portion on the opposite side to a connection to said catch which grip end portion is adapted to be griped by a user's hand;

said catch extends through a hole formed in said door; and said elastic member is generally L-shaped and has a first and second sections and a bend connecting the first and second sections, said first section being partially embedded in said catch, said second section and said bend being positioned outside said body, said second section extending generally in the same direction as said handle.

18. The combination as claimed in claim 17, wherein said elastic member further has an end portion connected integrally to said second portion on the opposite side to said first portion, said end portion being fastened to said door.

19. The combination as claimed in claim 17, wherein said handle is hinged to said door by pins.

20. The combination as claimed in claim 17, wherein said body has a projection adjacent to said bend, said projection and said bend together defining said hinge for said handle.

* * * * *